US010590958B2

(12) United States Patent
Tsubokawa

(10) Patent No.: US 10,590,958 B2
(45) Date of Patent: Mar. 17, 2020

(54) VACUUM PUMP

(71) Applicant: SHIMADZU CORPORATION, Kyoto (JP)

(72) Inventor: Tetsuya Tsubokawa, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 141 days.

(21) Appl. No.: 15/920,650

(22) Filed: Mar. 14, 2018

(65) Prior Publication Data

US 2018/0283400 A1 Oct. 4, 2018

(30) Foreign Application Priority Data

Mar. 29, 2017 (JP) ..... 2017-065948

(51) Int. Cl.

| | |
|---|---|
| ***F04D 29/58*** | (2006.01) |
| ***F04D 19/04*** | (2006.01) |
| ***F04D 25/06*** | (2006.01) |
| ***F04D 29/058*** | (2006.01) |

(52) U.S. Cl.

CPC ..... *F04D 29/5853* (2013.01); *F04D 19/042* (2013.01); *F04D 19/044* (2013.01); *F04D 25/06* (2013.01); *F04D 29/058* (2013.01)

(58) Field of Classification Search

None

See application file for complete search history.

(56) References Cited

U.S. PATENT DOCUMENTS

| | | | | |
|---|---|---|---|---|
| 9,822,783 | B2 * | 11/2017 | Tsubokawa | F04D 19/042 |
| 2015/0345494 | A1 | 12/2015 | Tsubokawa | |
| 2016/0348695 | A1 * | 12/2016 | Sakaguchi | F04D 19/042 |
| 2017/0002832 | A1 * | 1/2017 | Nonaka | F04D 19/046 |

FOREIGN PATENT DOCUMENTS

JP 2015-151932 A 8/2015

OTHER PUBLICATIONS

Chinese Office Action for corresponding Application No. 2018100783298, dated Aug. 23, 2019.

* cited by examiner

*Primary Examiner* — Christopher Verdier
*Assistant Examiner* — Jason A Fountain
(74) *Attorney, Agent, or Firm* — Renner, Otto, Boisselle & Sklar, LLP

(57) ABSTRACT

A vacuum pump comprises: a pump housing; a motor configured to rotate in the pump housing; a rotor configured to be rotatably driven by the motor; a stator provided between the rotor and the pump housing; and a heat insulating member provided between the stator and the pump housing. The heat insulating member has a cylindrical main body and a processing gripping target portion provided on at least one of inner and outer peripheral surfaces of the main body.

10 Claims, 7 Drawing Sheets

VACUUM PUMP

TECHNICAL FIELD

The present invention relates to a vacuum pump.

BACKGROUND ART

In a device configured to use a turbo-molecular pump to bring the inside of a chamber into a high-vacuum state for performing CVD film formation or etching, tendency shows, depending on the type of gas to be exhausted, that gas is condensed in the pump and a product adheres to the inside of the pump. A turbo-molecular pump has been known, in which for reducing such product adherence to a screw groove pump stage etc., a stator is fixed to a case through a heat insulating member so that a stator temperature decrease can be suppressed (see, e.g., Patent Literature 1 (JP-A-2015-151932)).

However, the above-described patent literature fails to describe mechanical processing of a contact surface between the heat insulating member and the case or the stator.

SUMMARY OF THE INVENTION

A vacuum pump comprises: a pump housing; a motor configured to rotate in the pump housing; a rotor configured to be rotatably driven by the motor; a stator provided between the rotor and the pump housing; and a heat insulating member provided between the stator and the pump housing. The heat insulating member has a cylindrical main body and a processing gripping target portion provided on at least one of inner and outer peripheral surfaces of the main body.

The heat insulating member has the processing gripping target portion on each of the inner and outer peripheral surfaces of the main body.

The main body has at least first and second cylindrical portions divided in an axial direction, and each of the first and second cylindrical portions has the processing gripping target portion on at least one of inner and outer peripheral surfaces of the each of the first and second cylindrical portions.

No flange extending in an outer circumferential direction is formed at both of upper and lower ends of a cylindrical main body of the heat insulating member.

A first step portion including a first lower surface and a first side surface is provided across the entire circumference of an outer peripheral portion of the stator, the first lower surface contacts an upper end surface of the cylindrical main body of the heat insulating member, and the first side surface contacts an upper contact surface provided at an upper portion of the inner peripheral surface of the cylindrical main body of the heat insulating member. A second step portion including an second upper surface and a second side surface is provided across the entire circumference of an inner peripheral portion of the pump housing, the second upper surface contacts a lower end surface of the cylindrical main body of the heat insulating member, and the second side surface contacts a lower contact surface provided at a lower portion of an outer peripheral surface of the cylindrical main body of the heat insulating member.

A contact surface between the stator and the heat insulating member and a contact surface between the heat insulating member and the pump housing employ vacuum sealing by metal touch.

The processing gripping target portion is a protrusion to be gripped with a processing jig.

The processing gripping target portion is provided on at middle position of an axial direction of the heat insulating member.

The processing gripping target portion has circular ring shape.

According to the present invention, a heat insulating member with a high processing accuracy can be provided without distortion of a cylindrical main body of the heat insulating member even when a processing target portion is thinly processed.

DETAILED DESCRIPTION OF THE EXEMPLARY EMBODIMENTS

Hereinafter, an embodiment of the present invention will be described with reference to the drawings.

Figure 1:
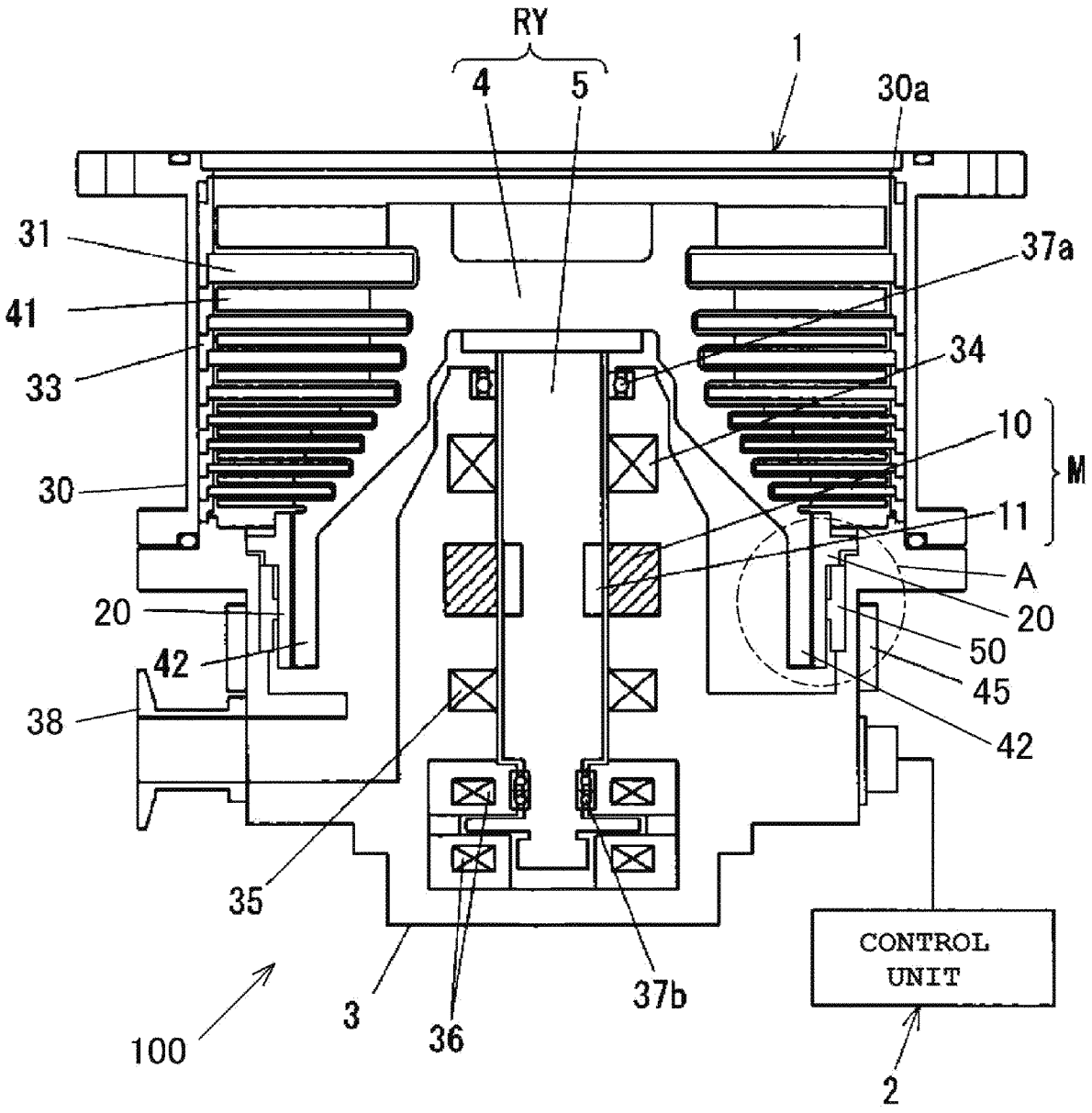
FIG. 1 is a view of a turbo-molecular pump as an example of a vacuum pump.

FIG. 1 is a view of a turbo-molecular pump as an example of a vacuum pump of the present embodiment. The turbo-molecular pump 100 includes a pump unit 1 configured to perform vacuum pumping, and a control unit 2 configured to drivably control the pump unit 1.

The pump unit 1 has a turbo pump stage including rotor blades 41 and stationary blades 31, and a drag pump stage (a screw groove pump stage) including a cylindrical portion 42 and a stator 20. In the screw groove pump stage, the stator 20 or the cylindrical portion 42 is provided with a screw groove. The rotor blades 41 and the cylindrical portion 42 forming a rotary-side exhaust function section are formed at a pump rotor 4. The pump rotor 4 is fastened to a shaft 5. The pump rotor 4 and the shaft 5 form a rotor unit RY.

The stationary blades 31 and the rotor blades 41 are alternately arranged in an axial direction. Each stationary blade 31 is placed on a base 3 through spacer rings 33. When a pump case 30 is fixed to the base 3 with bolts, the stack of the spacer rings 33 is sandwiched between the base 3 and a lock portion 30*a* of the pump case 30, and therefore, the positions of the stationary blades 31 are determined. The stator 20 is attached to the base 3 through a heat insulating member 50. The heat insulating member 50 will be described later in detail. The base 3 is provided with an exhaust pipe 38.

Note that the pump case 30 and the base 3 form a pump housing.

The turbo-molecular pump 100 illustrated in FIG. 1 is a magnetic levitation type turbo-molecular pump, and the rotor unit RY is non-contact supported by magnetic bearings 34, 35, 36 provided at the base 3.

The rotor unit RY is rotatably driven by a motor M. The motor M has a motor stator 10 and a motor rotor 11. When the magnetic bearings are not in operation, the rotor unit RY is supported by emergency mechanical bearings 37*a*, 37*b*. A heater 45 configured to control the temperature of the base 3 and a not-shown coolant water pipe are provided at the outer periphery of the base 3. These components form a temperature adjustment device placed at the base 3, and is placed for the purpose of adjusting the temperature of the exhaust pipe 38 to the vicinity of a gas sublimation temperature such that no gas product is accumulated in the vicinity of the base 3, e.g., the exhaust pipe 38.

Figure 2:
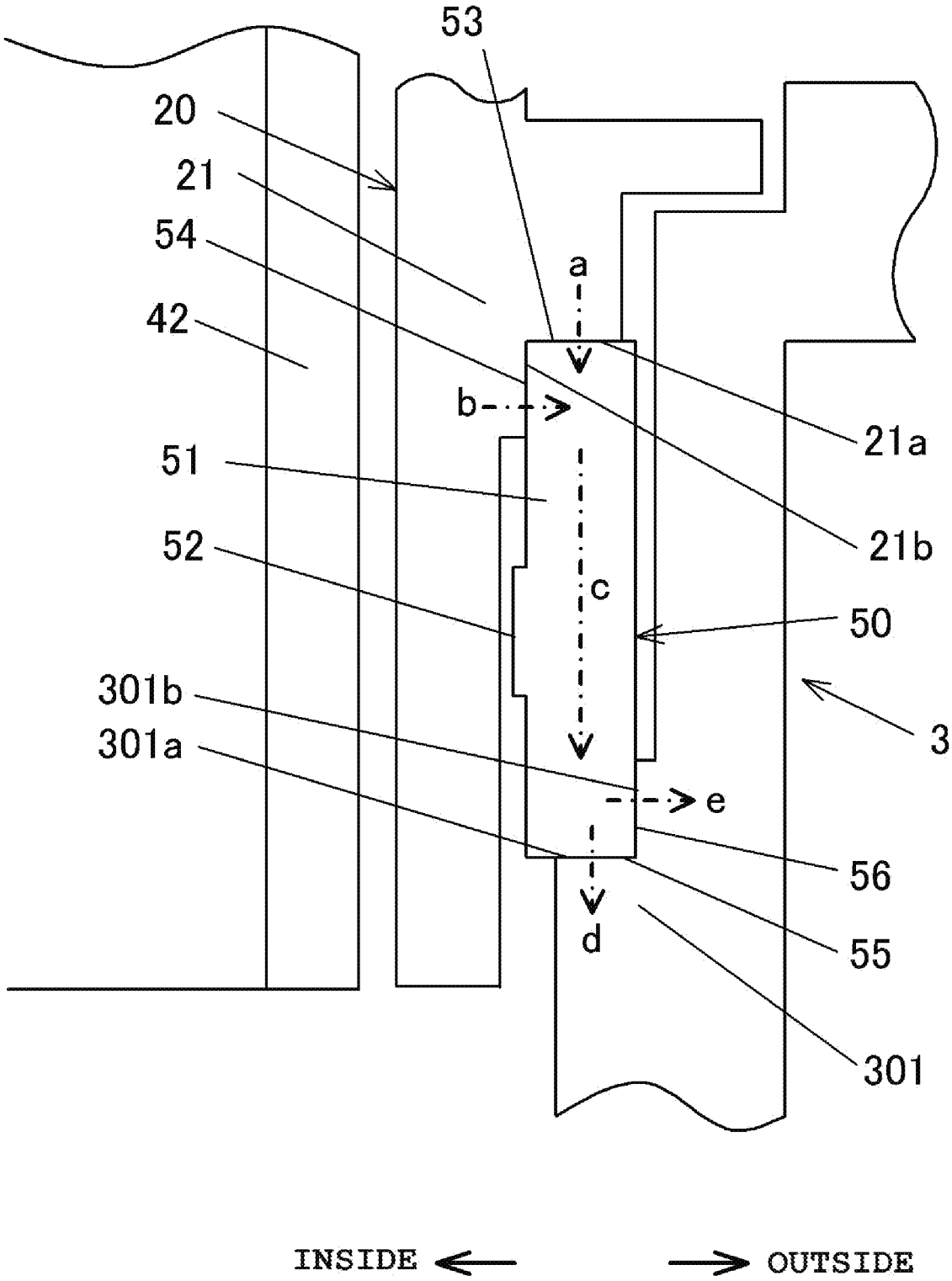
FIG. 2 is an enlarged view of a portion surrounded by a circle indicated by a chain line of FIG. 1.
Figure 3:
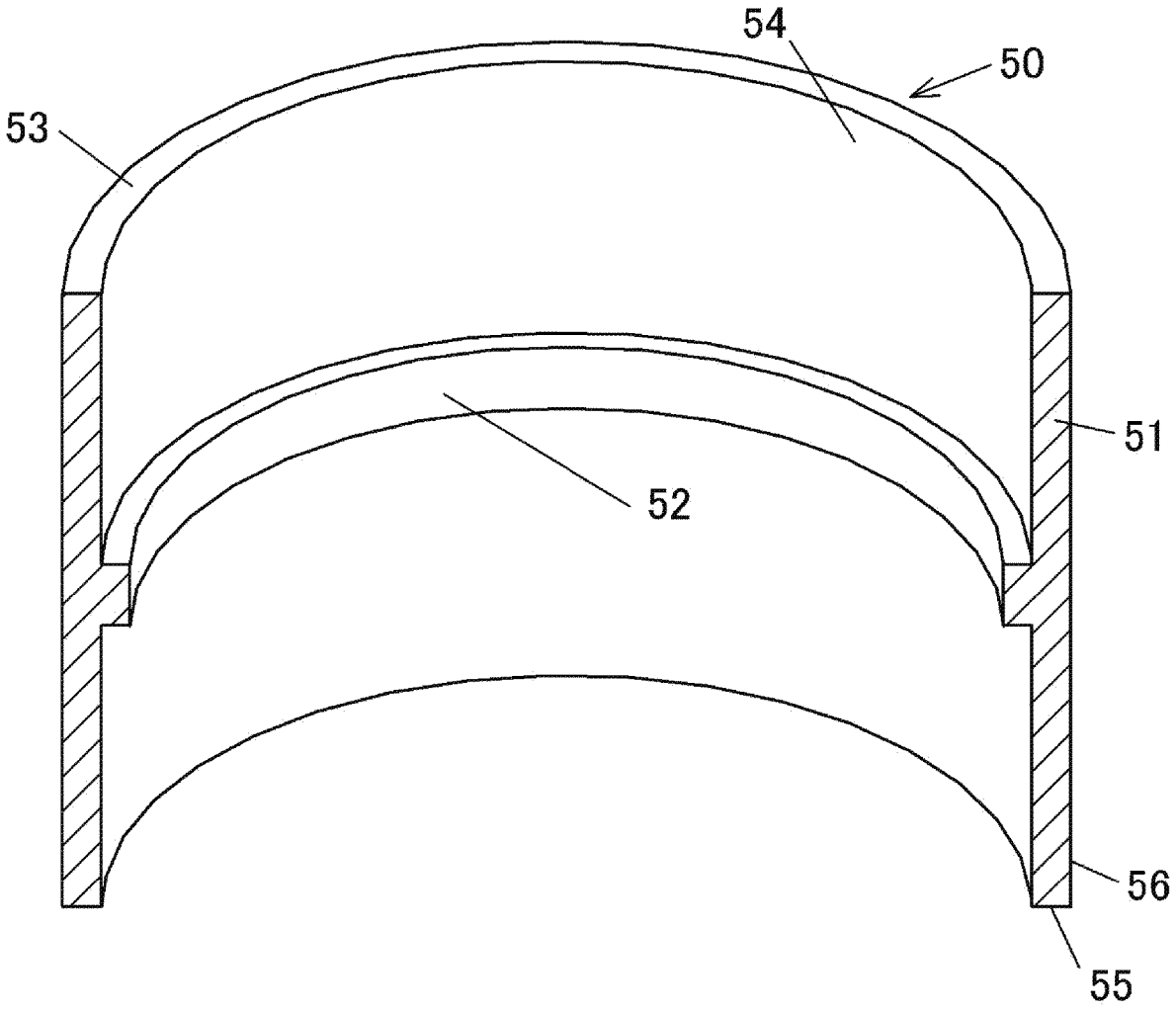
FIG. 3 is a schematic perspective sectional view of a heat insulating member along a cylinder axial direction.

FIG. 2 is an enlarged view of a portion surrounded by a circle A indicated by a chain line of FIG. 1, and FIG. 3 is a schematic perspective sectional view of the heat insulating member 50 along the cylinder axial direction. Note that the heater 45 is not shown in FIG. 2.

As illustrated in FIG. 2, the stator 20 is placed on the base 3 through the heat insulating member 50, and is fixed with not-shown bolts.

The heat insulating member 50 is a member in a cylindrical shape as illustrated in FIG. 3, and has a cylindrical portion 51 and a protrusion 52 protruding inward in a radial direction from an inner peripheral surface of the cylindrical portion 51. The heat insulating member 50 is made of a material, such as stainless steel, having a smaller coefficient of thermal conductivity than those of the stator 20 and the base 3 made of aluminum alloy. In the present embodiment, the protrusion 52 is provided across the entirety of the cylindrical portion 51 in a circumferential direction thereof.

An upper portion of the heat insulating member 50 contacts the stator 20, and a lower portion of the heat insulating member 50 contacts the base 3, as described above. That is, a step portion 21 contacting the heat insulating member 50 is provided across the entire circumference of an outer peripheral portion of the stator 20. The step portion 21 has a lower surface 21*a* and a side surface 21*b*. The lower surface 21*a* contacts an upper end surface 53 of the cylindrical portion 51 of the heat insulating member 50, and the side surface 21*b* contacts an upper contact surface 54 provided at an upper portion of the inner peripheral surface of the cylindrical portion 51 of the heat insulating member 50.

A step portion 301 contacting the heat insulating member 50 is provided across the entire circumference of an inner peripheral portion of the base 3. The step portion 301 has an upper surface 301*a* and a side surface 301*b*. The upper surface 301*a* contacts a lower end surface 55 of the cylindrical portion 51 of the heat insulating member 50, and the side surface 301*b* contacts a lower contact surface 56 provided at a lower portion of an outer peripheral surface of the cylindrical portion 51 of the heat insulating member 50.

As will be described later, the finishing accuracy of the upper and lower contact surfaces 54, 56 influences the positioning accuracy of the heat insulating member 50.

In recent years, miniaturization and performance improvement have been increasingly demanded in a liquid crystal field and a semiconductor field. With diversification of a gas type to be used, the amount of product accumulated in a pump has increased. For this reason, it has been demanded to set, to a higher temperature, the temperature of a pump constituent member in which a product tends to be accumulated. Meanwhile, it has been also demanded to set a clearance between a rotor inner cylindrical portion and the stator 20 to, e.g., equal to or less than 1 mm to improve pump performance.

For satisfying these specifications, the following structure may be employed in a recent vacuum pump: the heat insulating member 50 is interposed between the stator 20 and the base 3, and the position of the heat insulating member 50 is determined by fitting with the stator 20 and the base 3.

Description will be made with reference to FIG. 2. Such a vacuum pump employs a structure in which the upper contact surface 54 and the lower contact surface 56 of the heat insulating member 50 are each fitted with the side surface 21*b* of the stator 20 and the side surface 301*b* of the base 3. A contact surface between the stator 20 and the heat insulating member 50 and a contact surface between the heat insulating member 50 and the base 3 need to employ vacuum sealing by metal touch. Thus, at least a portion of inner and outer peripheral surfaces of the heat insulating member 50, i.e., the upper and lower contact surfaces 54, 56 in this example, need to be mechanically processed. A contact surface between the stator 20 and the base 3 is also subjected to mechanical processing, and in this manner, a vacuum sealing structure by the metal touch is employed.

Reduction in heat transfer by the heat insulating member will be described below, and then, a mechanical processing gripping portion of the heat insulating member will be described.

Heat Transfer Reduction

The stator 20 is heated by radiation heat from the cylindrical portion 42 or heat of friction with exhaust gas, and accordingly, the temperature of the stator 20 increases. Heat of the stator 20 is, as in arrows a, b indicated by chain lines of FIG. 2, mainly transferred from the lower surface 21*a* and the side surface 21*b* of the step portion 21 of the stator 20 to the upper end surface 53 and the upper contact surface 54 of the cylindrical portion 51 of the heat insulating member 50. Then, the heat transferred to the upper portion of the heat insulating member 50 is transferred down the heat insulating member 50 as in an arrow c indicated by a chain line, and then, is transferred from the lower end surface 55 and the lower contact surface 56 of the cylindrical portion 51 of the heat insulating member 50 to the upper surface 301*a* and the side surface 301*b* of the step portion 301 of the base 3 as in arrows d, e indicated by chain lines.

For reducing heat movement (heat transfer) from the stator 20 to the base 3, great thermal resistance of an axial heat transfer path as indicated by the arrow c of FIG. 2 is set. The axial length of the heat insulating member 50 is determined by the axial length of a screw formation portion of the stator 20. Thus, it is difficult to determine the axial length of the heat insulating member 50 as a preferable value for thermal resistance. For this reason, it is preferably designed that the radial thickness of the heat insulating member 50 with the specified axial length is decreased to obtain desired thermal resistance. That is, the radial thickness of the cylindrical portion 51 is decreased, and in this manner, heat transfer from the stator 20 to the base 3 is reduced. As a result, a higher temperature of the stator 20 can be held, and therefore, product adherence is reduced.

Mechanical Processing Gripping Portion of Heat Insulating Member

However, when the radial thickness of the cylindrical portion 51 of the heat insulating member 50 is decreased, if the outer peripheral surface of the cylindrical portion 51 of the heat insulating member 50 is, for example, chucked inward in the radial direction, the cylindrical portion 51 might be distorted in the case of strong chucking force, and the cylindrical portion 51 might not be able to be securely held in the case of weak chucking force. That is, when the upper contact surface 54 and the lower contact surface 56 are mechanically processed to predetermined diameters, it is difficult to grip the heat insulating member 50.

For this reason, the protrusion 52 is provided on the inner peripheral surface of the cylindrical portion 51 in the heat insulating member 50 of the present embodiment. When the upper contact surface 54 and the lower contact surface 56 are mechanically processed, a processing jig is used to grip the protrusion 52. That is, the protrusion 52 is a gripping target portion to be gripped with the processing jig.

Figure 4:
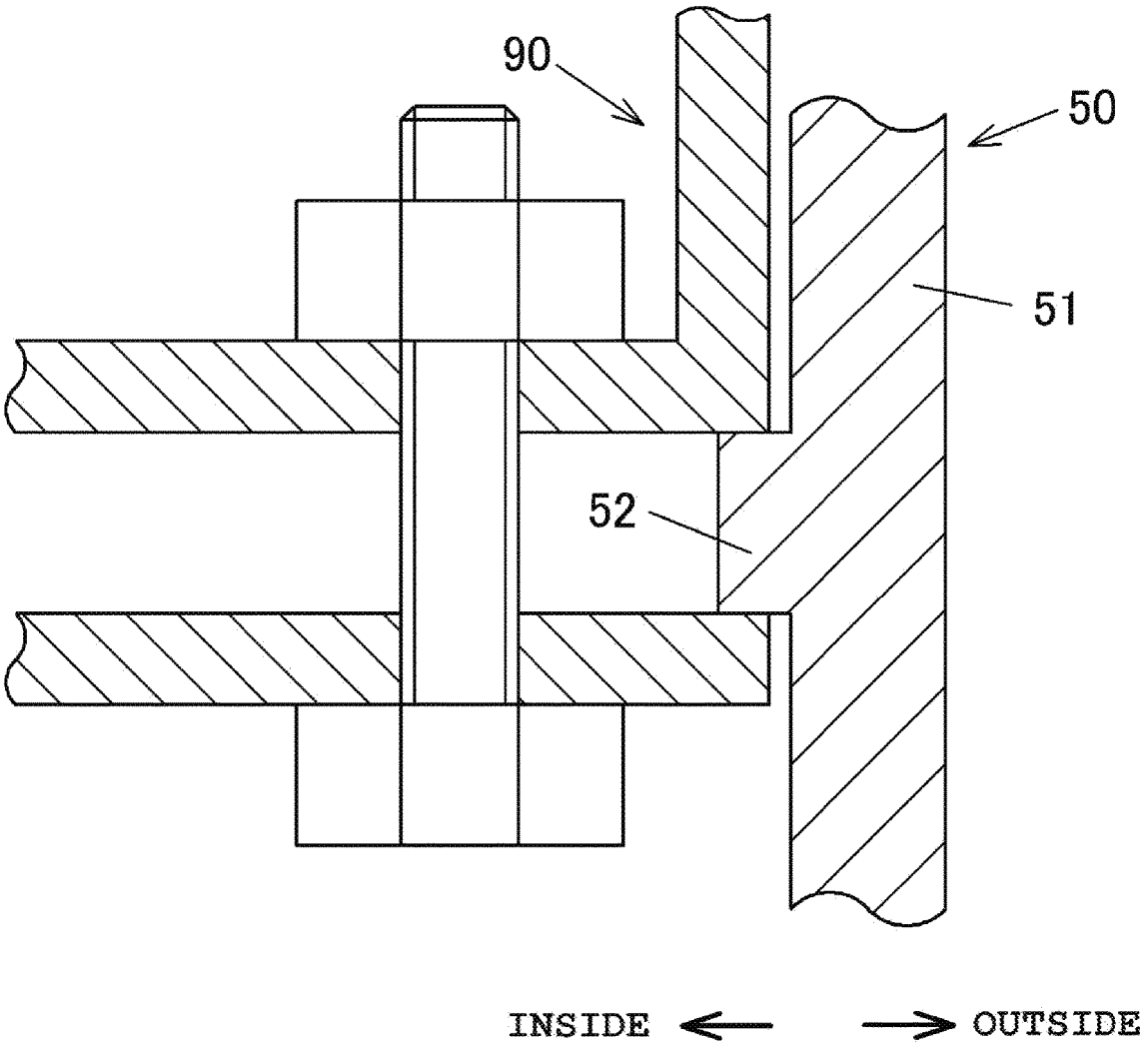
FIG. 4 is a schematic sectional view in a state in which a protrusion is gripped with a processing jig.

FIG. 4 is a schematic sectional view in a state in which the protrusion 52 is gripped with a processing jig 90. As illustrated in FIG. 4, the processing jig 90 is inserted into the cylindrical portion 51, and the processing jig 90 sandwiches upper and lower surfaces of the protrusion 52, for example. In this manner, the heat insulating member 50 is attached to the processing jig 90. When the upper contact surface 54 and the lower contact surface 56 are mechanically processed, a not-shown portion of the processing jig 90 protruding from the cylindrical portion 51 of the heat insulating member 50 is gripped with a processing jig of a processing machine. A cutting tool of the processing machine is arranged in the cylindrical portion 51 to cut the upper contact surface 54. A cutting tool of the processing machine is arranged outside the cylindrical portion 51 to cut the lower contact surface 56.

In this method, a processing target portion is not gripped, and therefore, outer and inner peripheral surfaces of the upper contact surface 54 and the lower contact surface 56 are mechanically processed so that the thicknesses of these portions can be thinly processed.

According to the above-described embodiment, the following features and advantageous effects are provided.

(1) The vacuum pump of the embodiment includes the base 3 as the pump housing, the motor M configured to rotate in the pump housing, the rotor 4 configured to be rotatably driven by the motor M, the stator 20 provided between the rotor cylindrical portion 42 as the component of the rotor 4 and the base 3, and the heat insulating member 50 provided between the stator 20 and the base 3. The heat insulating member 50 has the cylindrical portion 51 in a cylindrical shape and the protrusion 52 as the processing gripping target portion provided on the inner peripheral surface of the cylindrical portion 51.

The inner peripheral surface (the upper contact surface) 54 of the upper end surface 53 and the outer peripheral surface (the lower contact surface) 56 of the lower end surface 55 can be mechanically processed with the protrusion 52 on the inner peripheral surface of the heat insulating member 50 being gripped with the processing jig 90. It is not necessary to mechanically process the upper end surface 53 and the lower end surface 55 as the processing target portion with these surfaces being gripped, and the shape of the cylindrical portion is not distorted even when the upper end surface 53 and the lower end surface 55 are thinly finished.

The following variations also fall within the scope of the present invention, and one or more of the variations may be combined with the above-described embodiment.

(First Variation)

Figure 5:
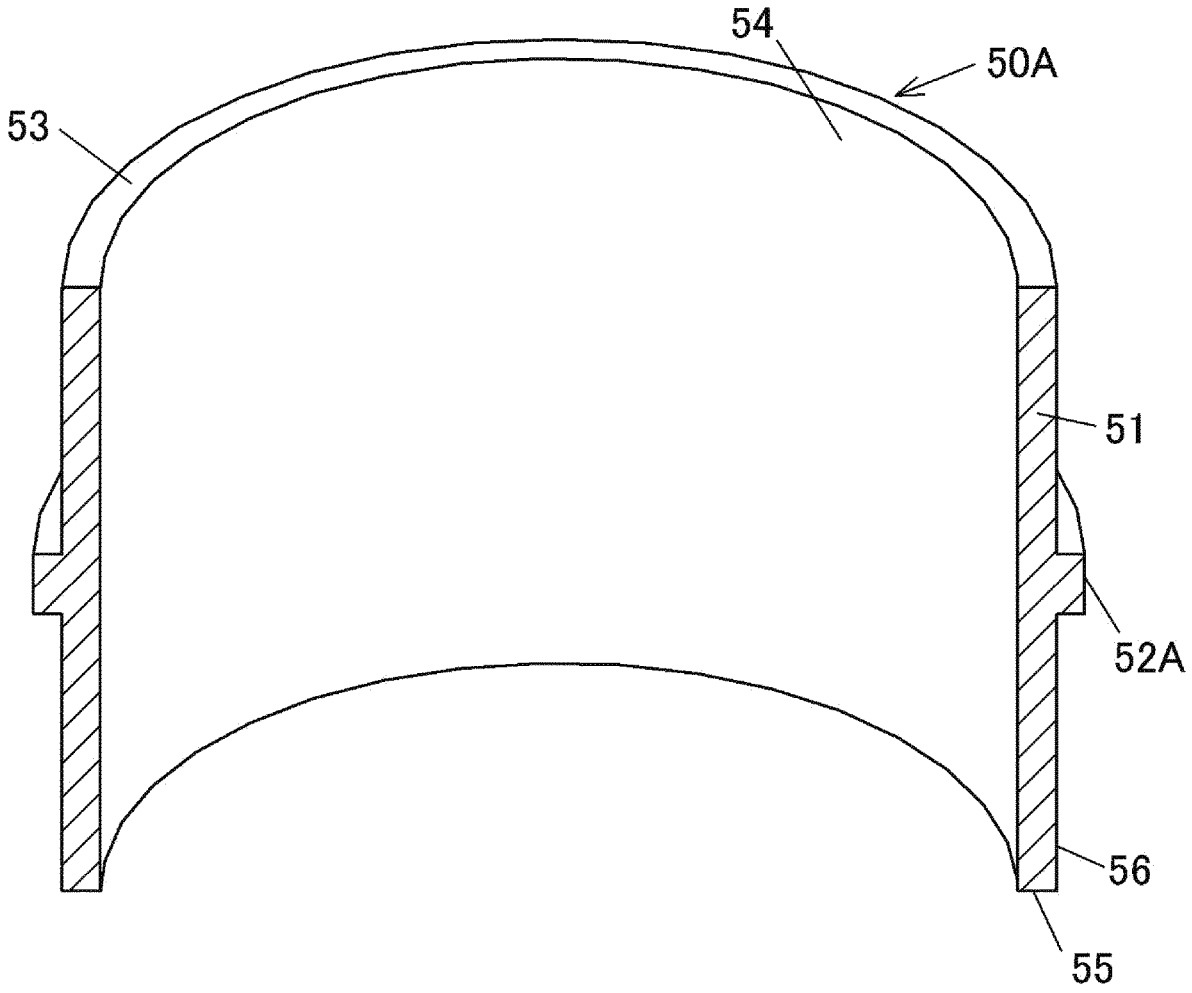
FIG. 5 is a view of a variation.

In description above, the protrusion 52 is provided on the inner peripheral surface of the cylindrical portion 51 of the heat insulating member 50. However, as illustrated in FIG. 5, a protrusion 52A may be provided on the outer peripheral surface of a cylindrical portion 51 of a heat insulating member 50A. FIG. 5 is a schematic perspective sectional view of the heat insulating member 50A of the present variation along the cylinder axial direction.

Figure 6:
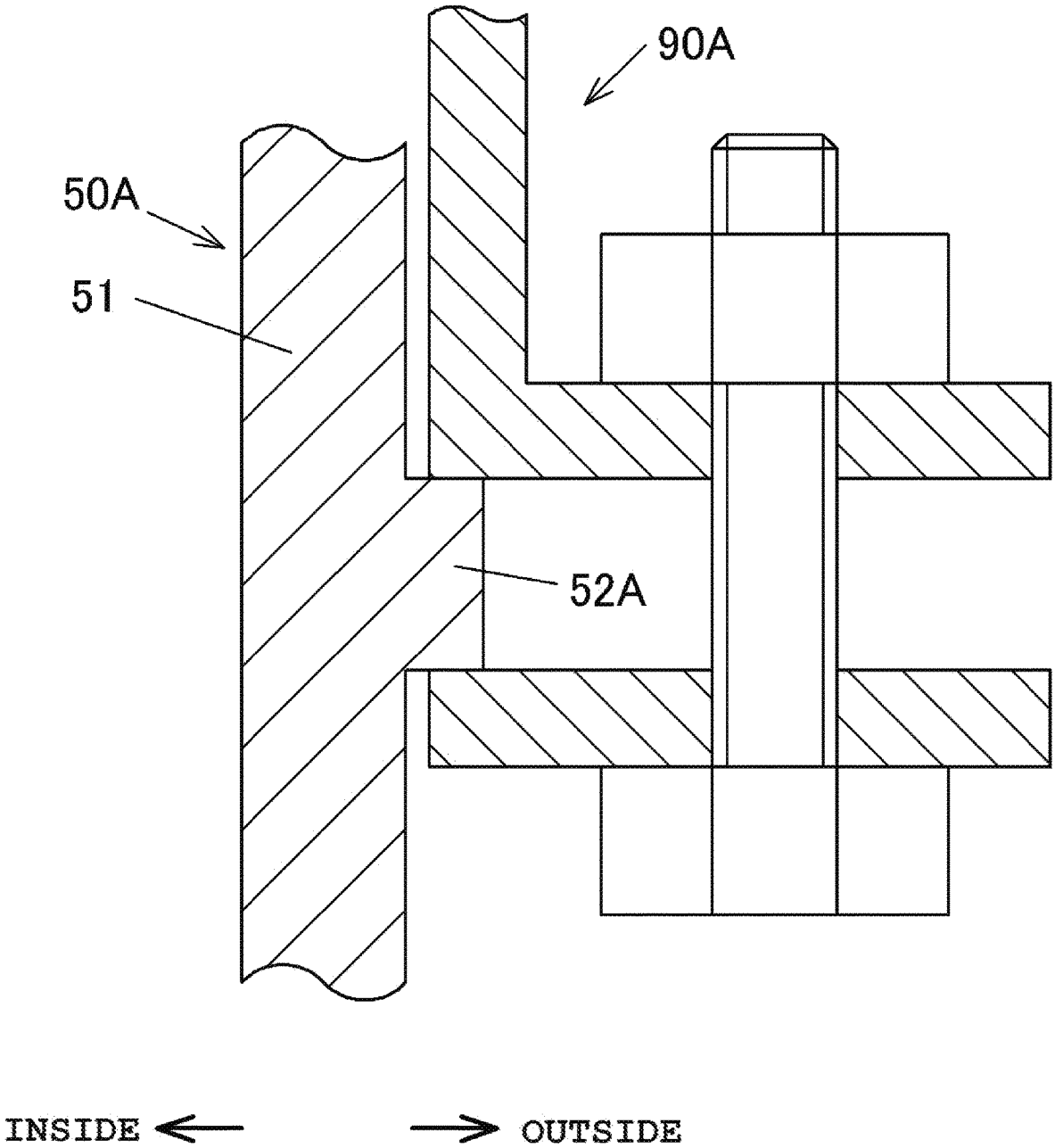
FIG. 6 is a view of the variation.

FIG. 6 is a schematic sectional view in a state in which the protrusion 52A is gripped with a processing jig 90A. As illustrated in FIG. 6, the processing jig 90A is attached to the outside of the cylindrical portion 51, and the processing jig 90A sandwiches upper and lower surfaces of the protrusion 52A. In this manner, the heat insulating member 50A can be attached to the processing jig 90A. The cutting tool of the processing machine is arranged in the cylindrical portion 51 to cut the upper contact surface 54. The cutting tool of the processing machine is arranged outside the cylindrical portion 51 to cut the lower contact surface 56.

Note that the protrusion 52 may be provided on the inner peripheral surface of the cylindrical portion 51 of the heat insulating member 50, and the protrusion 52A may be provided on the outer peripheral surface of the cylindrical portion 51 as illustrated in FIG. 5.

With these two protrusions, the inner peripheral surface can be mechanically processed with the inner peripheral side protrusion being gripped with the processing machine and the outer peripheral surface can be mechanically processed with the outer peripheral side protrusion being gripped with the processing machine when it is difficult to mechanically process the inner and outer peripheral surfaces in the case of providing only one of the protrusions.

(Second Variation)

In description above, the heat insulating member 50 is the integrated object in the cylindrical shape. However, as illustrated in FIG. 7, the heat insulating member 50 may be formed of a plurality of cylindrical portions divided into two or more portions along the cylinder axial direction.

Figure 7:
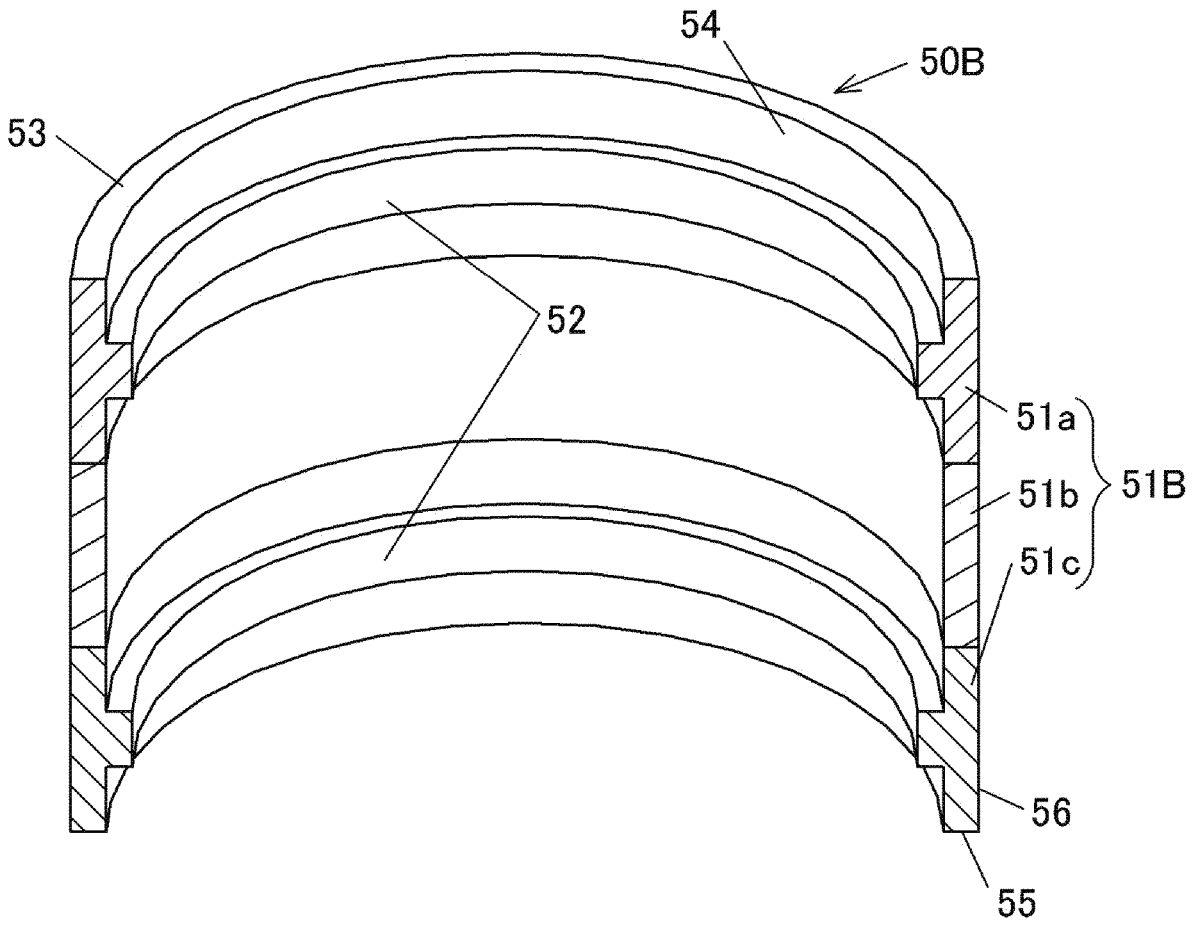
FIG. 7 is a view of another variation.

FIG. 7 is a schematic perspective sectional view of a heat insulating member 50B of the present variation along the cylinder axial direction. A cylindrical portion 51B of the heat insulating member 50B of the present variation is, for example, divided into three portions, and has an upper cylindrical portion 51*a*, a middle cylindrical portion 51*b*, and a lower cylindrical portion 51*c*. The upper contact surface 54 requiring mechanical processing is provided at the upper cylindrical portion 51*a*, and the lower contact surface 56 requiring mechanical processing is provided at the lower cylindrical portion 51*c*. Thus, the protrusions 52 are each provided at the upper cylindrical portion 51*a* and the lower cylindrical portion 51*c*. The middle cylindrical portion 51*b* has no portion requiring mechanical processing, such as the upper contact surface 54 and the lower contact surface 56. Thus, the protrusion 52 is omitted.

As described above, in the case where the heat insulating member 50B has the cylindrical portions divided into two or more portions along the cylinder axial direction, the protrusion 52 may be, as necessary, provided at each cylindrical portion.

The heat insulating member 50B with the divided structure in the second variation can be employed in a case where a stator length is long and it is difficult to mechanically process an upper end side inner peripheral surface and a lower end side outer peripheral surface of a single heat insulating member. That is, mechanical processing is performed with the protrusion 52 of the upper cylindrical portion 51*a* being gripped with the processing jig and the protrusion 52 of the lower cylindrical portion 51*c* being gripped with the processing jig.

(Third Variation)

In description above, the protrusion 52 is provided across the entirety of the cylindrical portion 51 in the circumferential direction thereof. However, as long as gripping with the processing jig 90 can be performed, the protrusion 52 is not provided across the entirety of the cylindrical portion 51 in the circumferential direction thereof, but may be discretely provided along the circumferential direction of the cylindrical portion 51.

As described above, a plurality of protrusions 52 is discretely provided in the circumferential direction at the heat insulating member of the third variation, and therefore, the weight of such a heat insulating member is reduced as compared to the heat insulating member configured such that the protrusion 52 is provided across the entire length in the circumferential direction.

The embodiment and the variations have been described above, but the present invention is not limited to these contents. Other aspects conceivable within the scope of the technical idea of the present invention are also included in the scope of the present invention.

Thus, the present invention is also applicable to a vacuum pump including only a screw groove pump stage without a turbo pump stage.

What is claimed is:

1. A vacuum pump comprising:

a pump housing;

a motor configured to rotate in the pump housing;

a rotor configured to be rotatably driven by the motor;

a stator provided between the rotor and the pump housing; and a heat insulating member provided between the stator and the pump housing, wherein the heat insulating member has a cylindrical main body including an upper contact surface provided at an upper portion of an inner peripheral surface of the cylindrical main body and a lower contact surface provided at a lower portion of an outer peripheral surface of the cylindrical main body, the upper contact surface is subjected to mechanical processing and contacts a side surface of the stator, the lower contact surface is subjected to mechanical processing and contacts a side surface of the pump housing, the heat insulating member has a processing gripping target portion gripped with a processing jig when the upper contact surface and the lower contact surface are mechanically processed, and the processing gripping target portion is provided on at least one of the inner and the outer peripheral surfaces of the main body and between the upper contact surface and the lower contact surface in an axial direction of the cylindrical main body.

2. The vacuum pump according to claim 1, wherein the heat insulating member has the processing gripping target portion on each of the inner and outer peripheral surfaces of the main body.

3. The vacuum pump according to claim 1, wherein the main body has at least first and second cylindrical portions divided in the axial direction, and each of the first and second cylindrical portions has the processing gripping target portion on at least one of the inner and the outer peripheral surfaces of the each of the first and second cylindrical portions.

4. The vacuum pump according to claim 1, wherein no flange extending in an outer circumferential direction is formed at both of upper and lower ends of the cylindrical main body of the heat insulating member.

5. The vacuum pump according to claim 1, wherein a first step portion including a first lower surface and a first side surface is provided across the entire circumference of an outer peripheral portion of the stator, the first lower surface contacts an upper end surface of the cylindrical main body of the heat insulating member, and the first side surface contacts the upper contact surface provided at the upper portion of the inner peripheral surface of the cylindrical main body of the heat insulating member, a second step portion including an second upper surface and a second side surface is provided across the entire circumference of an inner peripheral portion of the pump housing, the second upper surface contacts a lower end surface of the cylindrical main body of the heat insulating member, and the second side surface contacts the lower contact surface provided at the lower portion of an outer peripheral surface of the cylindrical main body of the heat insulating member.

6. The vacuum pump according to claim 1, wherein a contact surface between the stator and the heat insulating member and a contact surface between the heat insulating member and the pump housing employ vacuum sealing by metal touch.

7. The vacuum pump according to claim 1, wherein the processing gripping target portion is a protrusion.

8. The vacuum pump according to claim 1, wherein the processing gripping target portion is provided on at a middle position of the axial direction of the heat insulating member.

9. The vacuum pump according to claim 1, wherein the processing gripping target portion has a circular ring shape.

10. The vacuum pump according to claim 1, wherein the processing gripping target portion is provided closer to a middle of the cylindrical main body than to an upper end and lower end of the cylindrical main body in the axial direction.

* * * * *